US009695686B2

(12) United States Patent
Bouvier et al.

(10) Patent No.: US 9,695,686 B2
(45) Date of Patent: Jul. 4, 2017

(54) MUD PULSE TELEMETRY DEVICES, SYSTEMS, AND METHODS

(71) Applicant: Schlumberger Technology Corporation, Sugar land, TX (US)

(72) Inventors: Hugues Bouvier, Sugar Land, TX (US); Alain Guelat, Paris (FR); Remi Hutin, Bures sur Yvette (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/652,123

(22) PCT Filed: Dec. 13, 2013

(86) PCT No.: PCT/US2013/074850
§ 371 (c)(1),
(2) Date: Jun. 14, 2015

(87) PCT Pub. No.: WO2014/093735
PCT Pub. Date: Jun. 19, 2014

(65) Prior Publication Data

US 2015/0322780 A1 Nov. 12, 2015

(30) Foreign Application Priority Data

Dec. 13, 2012 (EP) ..... 12306583

(51) Int. Cl.
*E21B 47/18* (2012.01)

(52) U.S. Cl.
CPC ..... *E21B 47/182* (2013.01)

(58) Field of Classification Search
CPC ..... E21B 47/182
USPC ..... 367/84–86
See application file for complete search history.

(56) References Cited

U.S. PATENT DOCUMENTS

| | | | | |
|---|---|---|---|---|
| 5,583,827 | A | 12/1996 | Chin | |
| 6,714,138 | B1 * | 3/2004 | Turner | E21B 47/18 340/854.3 |
| 2002/0117306 | A1 | 8/2002 | Hahn et al. | |
| 2007/0056771 | A1 | 3/2007 | Gopalan et al. | |
| 2010/0230113 | A1 | 9/2010 | Hutin et al. | |
| 2010/0245121 | A1 * | 9/2010 | Reed | E21B 47/18 340/855.4 |

(Continued)

*Primary Examiner* — Qutbuddin Ghulamali

(57) ABSTRACT

Devices, systems and methods for transmitting downhole data are provided. The devices include a rotor-stator modulator configured for use in a drill string, and a drive and control system configured to drive the rotor according to a modulation scheme resulting in both oscillating and full rotational movement. The modulation scheme can comprise a trajectory algorithm such as a QAM trajectory algorithm. The systems include a modulator disposed within a drill string which creates modulated pulses according to an algorithm providing for both oscillating and full rotational movement of the rotor, and may also include a demodulator. The methods include transmitting coded data by driving a rotor relative a stator disposed in a drill string according to a modulation scheme that provides both oscillating and full rotational movement and results in modulated mud pulses representative of data recorded downhole, and may involve decoding the data.

18 Claims, 7 Drawing Sheets

(56) References Cited

U.S. PATENT DOCUMENTS

2014/0072063 A1* 3/2014 Hansen ..... H04B 10/5161
375/265

* cited by examiner

QAM CIRCULAR CONSTELLATION WITH ONLY 2 AMPLITUDES

16-QAM CIRCULAR CONSTELLATION

MUD PULSE TELEMETRY DEVICES, SYSTEMS, AND METHODS

FIELD

The present disclosure relates to oil and gas exploration, and more particularly to transmitting downhole information to the surface. The present disclosure also relates to devices, systems and methods for mud pulse telemetry.

BACKGROUND

Oil prices continue to rise in part because the demand for oil continues to grow, while stable sources of oil are becoming scarcer. Oil companies continue to develop new tools for generating data from boreholes with the hope of leveraging such data by converting it into meaningful information that may lead to improved production, reduced costs, and/or streamlined operations.

The measured data may be communicated to the surface through mud pulse telemetry techniques, in which drilling fluid or "mud" is used as a propagation medium for a signal wave, such as a pressure wave, and one or more features of the wave is/are modulated to represent the recorded digital data. As the wave propagates to the surface, these modulations may be detected and a demodulator at the surface can reconstruct the digital data.

As logging tools increase in sophistication, so too does the volume of logging data they record. Accordingly, telemetry must keep pace or it may become a bottleneck for real-time data acquisition and/or quality data transmission.

SUMMARY

The present disclosure relates to devices, systems, and methods for transmitting subsurface data obtained during measurement-while-drilling (MWD) or logging-while-drilling (LWD) operations to the surface.

In some embodiments, the device is a mud pulse telemetry device, which includes a modulator comprising a motor-driven rotor-stator combination configured for use in a drill string, and a drive and control system for operating the motor to drive the rotor according to a modulation scheme resulting in both oscillating movement and classic (full) rotational movement of the rotor relative to the stator. In further embodiments, the modulation scheme, which provides for both oscillating and full rotational movement, is carried out according to an algorithm of formula (1):

$$S(t)=(P\text{max}-P\text{min})*\sin(\text{trajectory}(t))+P\text{avg} \quad (1),$$

wherein, S(t) represents the sonic (pressure) wave, Pmax is the pressure at the closed position, Pmin is the pressure at the open position, sin is a sine wave related to the design of the rotor blades, trajectory(t) is a trajectory algorithm, t represents time, and Pavg is average pressure. In yet further embodiments the trajectory algorithm is a quadrature amplitude modulation (QAM) trajectory algorithm of formula (2) and formula (3):

$$S(t)=(P\text{max}-P\text{min})*\text{Sin}(2\pi ft+\phi_n)*A_n+P\text{avg} \quad (2)$$

$$\text{and trajectory}(t)_n=A\ \sin(\text{Sin}(2\pi ft+\phi_n)*A_n) \quad (3),$$

wherein, f is the carrier frequency, $A_n$ is amplitude, and $\phi_n$ is phase.

In some embodiments, the modulation scheme is carried out wherein the amplitude and phase transitions are performed simultaneously using a trajectory σ(t) which possesses the following attributes:

- $\phi(t)$ is derivable two times for t ranging from $t_n$ to $t_{n+1}$
- $\phi(t_n)=0$ and $\phi(t_{n+})=1$
- $\phi(t)$ is a function that allows smoothly completing the transition from trajectory $t_n$ to $t_{n+1}$:

$$\text{trajectory}(t)=(\text{trajectory}(t)_{n+1}*\phi(t)+\text{trajectory}(t)_n*(1-\phi(t)),$$

and when $A_n=1$, the motor drives the rotor to continue the trajectory $\phi(t)$ without going backward when at maximum or minimum pressure.

In some embodiments, the modulation scheme is based on a circular QAM constellation diagram. In further embodiments, a symbol located on the outermost ring of the constellation diagram results in the motor driving the rotor to continue its trajectory without going backward when at maximum or minimum pressure. In some embodiments, the circular constellation diagram is a QAM constellation diagram with two amplitudes. In some embodiments, the circular constellation diagram is a 16-QAM circular constellation diagram, with the innermost ring representing a 25% amplitude, the second innermost ring representing a 50% amplitude, the third ring representing a 75% amplitude and the outermost ring representing full amplitude.

In some embodiments, the systems include a rotor-stator modulator unit disposed within a drill string such that drilling fluid can flow through the unit; and, a control and drive system configured to drive the rotor relative the stator according to a modulation scheme resulting in both oscillating movement and full rotational movement of the rotor relative the stator. In further embodiments, the control and drive system includes a motor for driving the rotor, and a processor which encodes recorded data according to the modulation scheme and instructs the motor to drive the rotor in a manner resulting in modulated mud pulses (pressure fluctuations in the drilling fluid) representative of the recorded data. In yet further embodiments, the instructions are in accordance with a modulation scheme that causes the motor to drive the rotor in full rotational movement if maximum amplitude is reached. In some embodiments, the systems further include a processor, which may be the same control and drive system processor in embodiments having such a control and drive system, for decoding the pressure fluctuations in the drilling fluid resulting from movement of the rotor.

In some embodiments, the methods of transmitting downhole information to surface involve driving a rotor-stator modulator unit disposed within a drill string according to a modulation scheme resulting in both oscillating movement and full rotational movement of the rotor relative the stator, wherein the movement of the rotor generates an encoded signal comprising pressure fluctuations in drilling fluid passing through the rotor-stator unit. In further embodiments, the modulation scheme is carried out according to algorithms of formulas (2) and (3). In yet further embodiments, when the amplitude reaches its maximum, the motor drives the rotor to continue its trajectory without going backward when at its maximum or minimum pressure. In some embodiments, the modulation scheme is based on a circular constellation diagram having an outermost ring, and when the modulation scheme includes a symbol on the outermost ring, the method comprises driving the rotor to continue its trajectory without going backward when at maximum or minimum pressure.

The identified embodiments are exemplary only and are therefore non-limiting. The details of one or more non-limiting embodiments of the invention are set forth in the accompanying drawings and the descriptions below. Other embodiments of the invention should be apparent to those of ordinary skill in the art after consideration of the present disclosure.

BRIEF DESCRIPTION OF DRAWINGS

FIG. 2*a* provides an exploded, stylized illustration of the modulator disposed in a drill string. FIG. 2*b* is a top-view stylized illustration of a modulator in the fully closed position. FIG. 2*c* is a top-view stylized illustration of a modulator in the fully open position.

FIG. 3*d* is an illustration of one such embodiment engaged with a stator.

DETAILED DESCRIPTION

Figure 1:
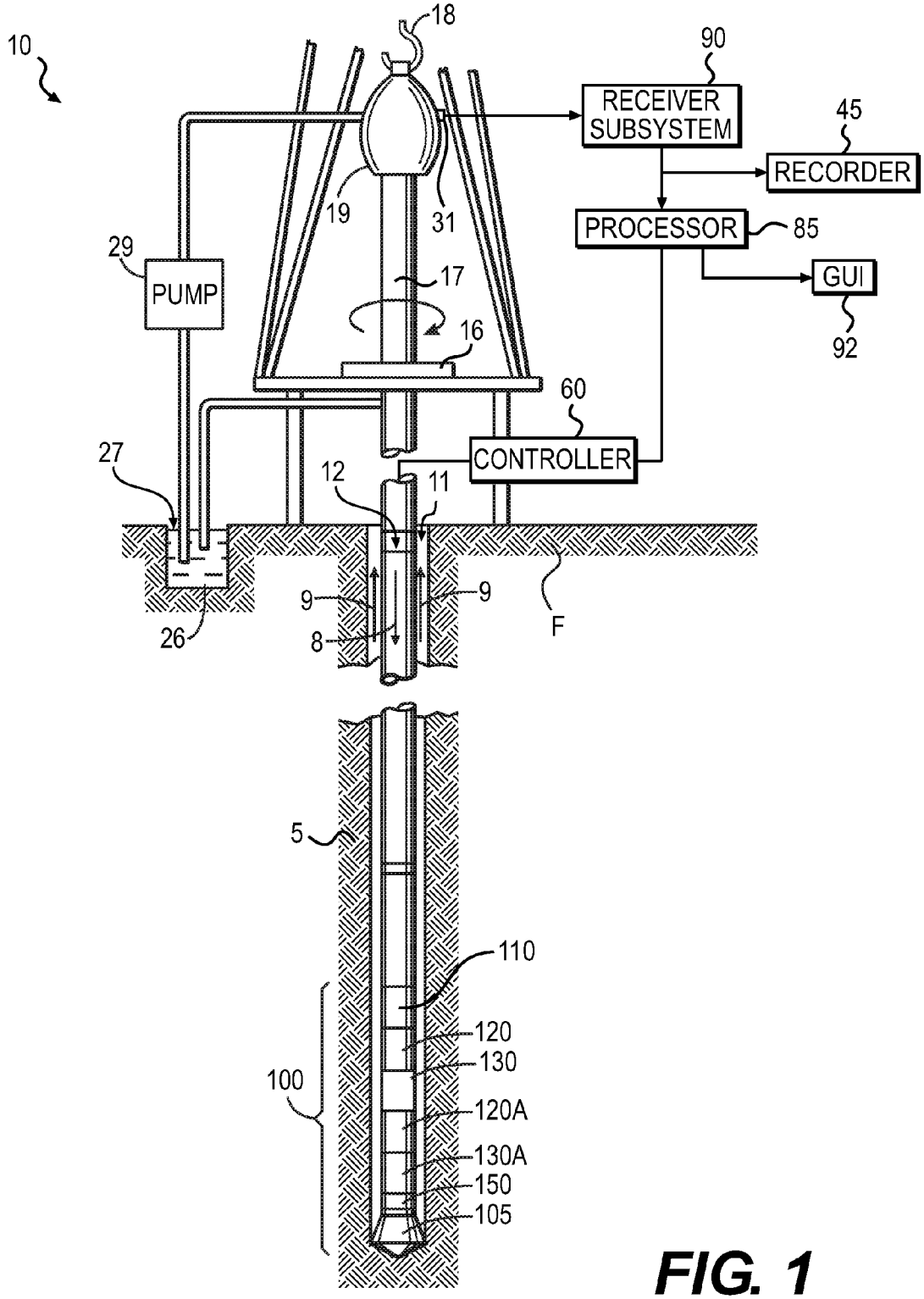
FIG. 1 is a partial schematic representation of an exemplary apparatus for logging while drilling that is compatible with the devices, systems and methods of this disclosure.

One or more embodiments are described below. The described embodiments are only examples of devices, systems and methods in accordance with the disclosure. As well, in an effort to provide a concise description of the example embodiments, all features of an actual implementation may not be described in the specification. It should be appreciated that in the development of any such actual implementations, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Unless defined otherwise, all technical and scientific terms used herein have the same meaning as is commonly understood by one of ordinary skill in the art to which this disclosure belongs. In the event that there is a plurality of definitions for a term herein, those in this section prevail unless stated otherwise.

The terms "a", "an," "the," and "said" when used to describe components of an embodiment, are intended to mean that the embodiment may include one or more of the components.

Where ever the phrases "for example," "such as," "including" and the like are used herein, the phrase "and without limitation" is understood to follow unless explicitly stated otherwise. Therefore, "for example a mud turbine generator" means "for example and without limitation a mud turbine generator."

The terms "comprising" and "including" and "involving" (and similarly "comprises" and "includes" and "involves") are used interchangeably and mean the same thing. Specifically, each of the terms is defined consistent with the common United States patent law definition of "comprising" and is therefore interpreted to be an open term meaning "at least the following" and also interpreted not to exclude additional features, limitations, aspects, etc.

The term "about" is meant to account for variations due to experimental error. All measurements or numbers are implicitly understood to be modified by the word about, even if the measurement or number is not explicitly modified by the word about.

The term "substantially" (or alternatively "effectively") is meant to permit deviations from the descriptive term that don't negatively impact the intended purpose. Descriptive terms are implicitly understood to be modified by the word substantially, even if the term is not explicitly modified by the word substantially.

The terms "wellbore" and "borehole" are used interchangeably.

The phrases "bottom hole assembly" and "downhole tool" are used interchangeably.

"Measurement While Drilling" ("MWD") can refer to devices for measuring downhole conditions including the movement and location of the drilling assembly contemporaneously with the drilling of the well. "Logging While Drilling" ("LWD") can refer to devices concentrating more on the measurement of formation parameters. While distinctions may exist between these terms, they are also often used interchangeably. For purposes of this disclosure MWD and LWD are used interchangeably and have the same meaning. That is, both terms are understood as related to the collection of downhole information generally, to include, for example, both the collection of information relating to the movement and position of the drilling assembly and the collection of formation parameters.

In the equations herein, the symbols are as follows:

- t represents time
- $\phi$ represents the position of the rotor, wherein $\phi(t)$ is time dependent and varies from $\pi/2$, representing the modulator's fully "closed" position (the blades of the rotor block the openings of the stator to the maximum extent possible) and maximum achievable system pressure, to $-\pi/2$ representing the modulator's fully "open" position (the blades of the rotor block the openings of the stator to the minimum extent possible, e.g. the blades do not block the openings at all) and minimum achievable system pressure.
- f represents the carrier frequency
- $\phi$ represents the phase shift
- $\rho$ represents the amplitude shift factor
- P(t) represents the pressure change in amplitude
- S(t) represents the sonic (pressure) wave
- $P_o(t)$ represents the power required
- I represents the inertia of the rotor
- $F(\phi)$ represents the signal due to the mechanical shape of the rotor, and is dependent on the rotor's position.

Referring now to the figures, wherein like reference numbers indicate like components, FIG. 1 illustrates a non-limiting, exemplary well logging system used to obtain well logging data and other information, which may be transmitted to surface using the mud pulse telemetry devices, systems and methods covered by this disclosure.

FIG. 1 illustrates a land-based platform and derrick assembly (drilling rig) 10 and drill string 12 with a well logging data acquisition and logging system, positioned over a wellbore 11 for exploring a formation F. In the illustrated embodiment, the wellbore 11 is formed by rotary drilling in a manner that is known in the art. Those of ordinary skill in the art given the benefit of this disclosure will appreciate, however, that the subject matter of this disclosure also finds application in directional drilling applications as well as rotary drilling, and is not limited to land-based rigs.

A drill string 12 is suspended within the wellbore 11 and includes a drill bit 105 at its lower end. The drill string 12 is rotated by a rotary table 16, energized by means not shown, which engages a kelly 17 at the upper end of the drill string. The drill string 12 is suspended from a hook 18, attached to a travelling block (also not shown), through the kelly 17 and a rotary swivel 19 which permits rotation of the drill string 12 relative to the hook 18.

Drilling fluid or mud 26 is stored in a pit 27 formed at the well site. A pump 29 delivers the drilling fluid 26 to the interior of the drill string 12 via a port in the swivel 19, inducing the drilling fluid to flow downwardly through the drill string 12 as indicated by the directional arrow 8. The drilling fluid exits the drill string 12 via ports in the drill bit 105, and then circulates upwardly through the region between the outside of the drill string 12 and the wall of the wellbore, called the annulus, as indicated by the direction arrows 9. In this manner, the drilling fluid lubricates the drill bit 105 and carries formation cuttings up to the surface as it is returned to the pit 27 for recirculation.

The drill string 12 further includes a bottomhole assembly ("BHA"), generally referred to as 100, near the drill bit 105 (for example, within several drill collar lengths from the drill bit). The BHA 100 includes capabilities for measuring, processing, and storing information, as well as communicating with the surface. The BHA 100 thus may include, among other things, one or more logging-while-drilling ("LWD") modules 120, 120A and/or one or more measuring-while-drilling ("MWD") modules 130, 130A. The BHA 100 may also include a roto-steerable system and motor 150.

The LWD and/or MWD modules 120, 120A, 130, 130A can be housed in a special type of drill collar, as is known in the art, and can contain one or more types of logging tools for investigating well drilling conditions or formation properties. The logging tools may provide capabilities for measuring, processing, and storing information, as well as for communication with surface equipment.

The BHA 100 may also include a surface/local communications subassembly 110, which may be configured to enable communication between the tools in the LWD and/or MWD modules 120, 120A, 130, 130A and processors at the earth's surface. For example, the subassembly may include a telemetry system in accordance with this disclosure that includes a modulator comprising a motor driven rotor-stator unit that generates an acoustic signal in the drilling fluid (a.k.a. "mud pulse") that is representative of measured downhole parameters. More specifically, and as described in more detail below, in some embodiments, a motor provides mechanical force to the rotor, which may drive the motor or cause the rotor to brake, and in any event rotate the rotor with respect to a stator resulting in selectively inhibiting the flow of drilling fluid through holes in the stator thereby generating pressure pulses (i.e. the acoustic signal).

The acoustic signal is received at the surface by instrumentation that can convert the acoustic signals into electronic signals. For example, the generated acoustic signal may be received at the surface by transducers. The output of the transducers may be coupled to an uphole receiving system 90, which demodulates the transmitted signals. The output of the receiving system 90 may be coupled to a computer processor 85 and a recorder 45. The computer processor 85 may be coupled to a monitor, which employs graphical user interface ("GUI") 92 through which the measured downhole parameters and particular results derived therefrom are graphically or otherwise presented to the user. In some embodiments, the data is acquired real-time and communicated to the back-end portion of the data acquisition and logging system. In some embodiments, the well logging data may be acquired and recorded in the memory in downhole tools for later retrieval.

The LWD and MWD modules 120, 120A, 130, 130A may also include an apparatus for generating electrical power to the downhole system. Such an electrical generator may include, for example, a mud turbine generator powered by the flow of the drilling fluid, but other power and/or battery systems may be employed additionally or alternatively.

The well-site system also includes a drive and control system for operating the modulator. In some embodiments, the drive and control system includes a motor (not shown) for driving the rotor. As shown, the drive and control system may also include an electronics subsystem comprising a controller 60 and a processor 85, which may optionally be the same processor used for analyzing logging tool data and which together with the controller 60 can serve multiple functions. For example, the controller 60 and processor 85 may be used to power and operate the logging tools in addition to the rotor-stator unit (which in the exemplified embodiment is a motor-driven rotor-stator unit). The drive and control system need not be on the surface as shown but may be configured in any way known in the art. For example, alternatively, or in addition, as is known in the art, the drive and control system (or the drive and/or the control system) may be part of an MWD (or LWD) module.

In the devices, systems, and methods according to this disclosure, the drive and control system (the electronics subsystem in the embodiment of FIG. 1), whether located on the surface or sub-surface or some combination thereof, processes encoded data to drive the rotor (e.g. to operate a motor to drive the rotor) relative the stator resulting in modulated mud pulses representative of the recorded data. The modulated mud pulses, which are created both by fully rotational and oscillating movement of the rotor relative the stator, propagate through the drilling fluid in the drill string, and the variations in the mud pulses may be detected by one or more sensors 90 at the surface of the system and may be processed by a computer 85 to reconstruct the original data.

Figure 2A:
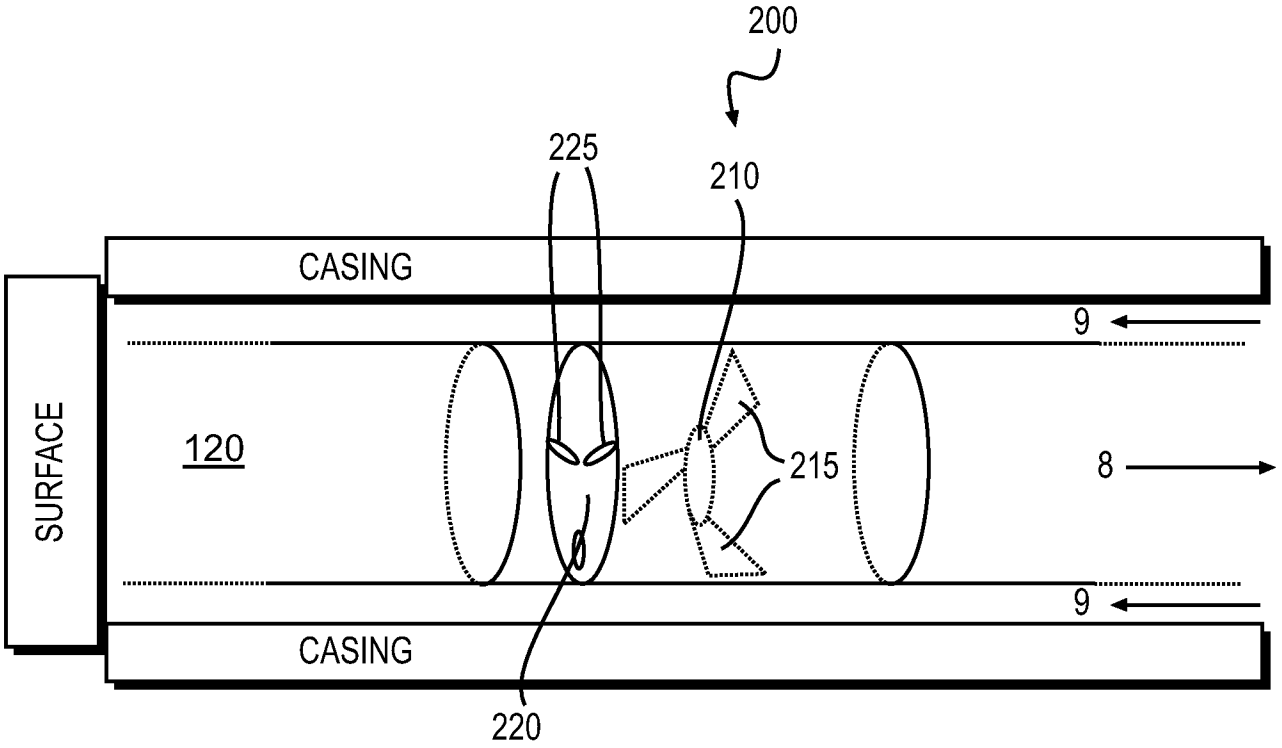
FIGS. 2*a*-2*c* are stylized illustrations of an embodiment of a modulator compatible with the devices, systems and methods of this disclosure.
Figure 2C:
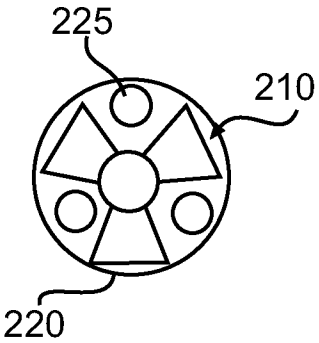
Figure 2B:
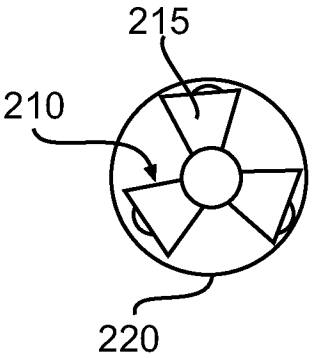

Referring now to FIG. 2, the mud pulse telemetry modulator according to this disclosure is a motor-driven rotor-stator type modulator operated by a control and drive system that drives the rotor according to a modulation scheme resulting in motion comprising both oscillating movement of the rotor relative the stator as well as full rotational movement of the rotor relative the stator. FIGS. 2*a-c* are stylized illustrations of a rotor-stator unit 200 suitable for use in accordance with devices, systems and methods of this disclosure. FIG. 2*a* shows the rotor-stator unit disposed in a drill string segment, whereas FIGS. 2*a* and 2*b* are top view illustrations of the rotor-stator unit in a fully closed and fully open position, respectively. Although the components of the drive system are not shown, as a person of ordinary skill appreciates, the rotor-stator unit can be a motor-driven rotor stator unit.

As shown, the unit includes a rotating rotor 210 including a number of blades 215 and a stationary stator 220 with a number of openings 225. In the exemplified embodiment, the stator has three openings 22, which corresponds to the number of blades 215 on the rotor 210. As shown in FIG. 2*b*, when the rotor-stator unit is in the "closed" position, the rotor blades 215 are in front of the stator openings 225, mud flow is blocked and the highest mud pressure is observed at the surface. (Also as shown in FIG. 2*b*, person of skill understands, even in the fully closed position, some mud flow occurs through the stator to avoid detrimental build-up of pressure in the drill string.) As shown in FIG. 2*c*, when the rotor-stator unit is the "open" position, mud flows freely through the stator openings 225 and the lowest mud pressure is observed at the surface.

Figures 3A, 3B, 3C:
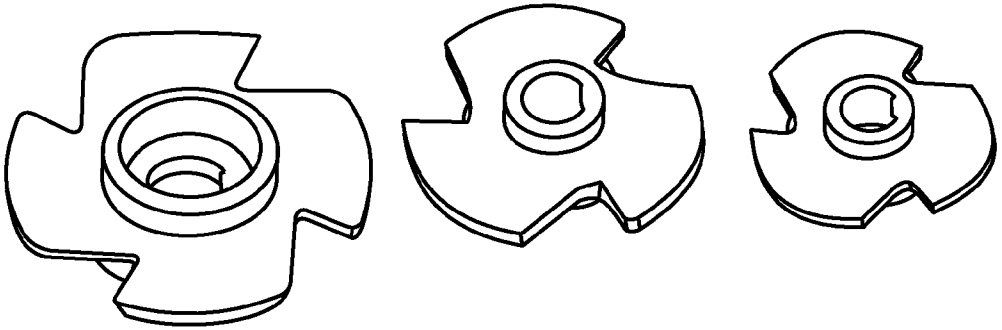
FIGS. 3*a*-*d* are illustrations of several different rotor embodiments that are compatible with the devices, systems and methods of this disclosure.
Figure 3D:
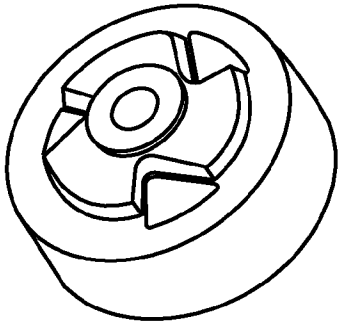
Figure 5:
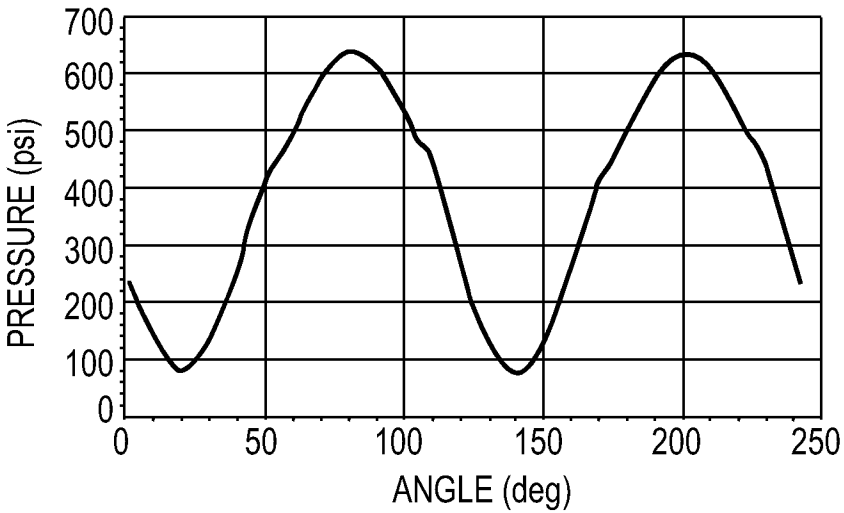
FIG. 5 is a graph of a sine wave produced by a rotor-stator unit compatible with devices, systems and methods in accordance with this disclosure, when the rotor is rotating at constant speed.

Devices, systems and methods in accordance with this disclosure can use a variety of rotor-stator units. FIGS. 3*a-c* are illustrations of examples of various types of rotors that may be used in the rotor-stator unit, and FIG. 3*d* depicts the rotor of FIG. 3*b* engaged in a stator. As is shown in the figures, the rotor may have a varying number of blades, in a variety of shapes. Similarly, the number of openings in the stator may vary from three and may vary from the illustrated shape. Generally, any rotor-stator configuration may be used provided that it can substantially produce a sine wave (such as shown in FIG. 5) when the rotor is rotating at constant speed such as is described in the following formula (4):

$$S(t)=\text{Pressure wave amplitude}*\sin(\phi(t))+\text{pressure average} \quad (4),$$

wherein $-\pi/2$ (pressure minimum) is considered to be the open position and $\pi/2$ (pressure maximum) is considered to be the closed position, and $\phi$ represents the position of the rotor. Accordingly, when the motor rotates at constant speed as follows:

$$P_o(t) = \frac{d^2\theta(t)}{d^2t} * I, \quad (5)$$

wherein $P_o(t)$ represents the power required and I is the inertia of the rotor, it only has to accelerate or decelerate around this constant speed to produce changes of phase.

In addition to the rotor-stator unit (in this embodiment a motor-driven rotor-stator unit), the telemetry system includes a control and drive system, which encodes data obtained by downhole tools according to a modulation scheme that results in operating the motor to drive the rotor relative the stator in motion comprising both oscillating motion and full rotational motion of the rotor. In some embodiments, the modulation scheme is a QAM modulation scheme which is interpreted to result in both oscillating motion and full rotational motion of the rotor relative the stator. For example, the rotor is driven according to classic rotation (full rotational motion) when the data is encoded using maximum amplitude.

In some embodiments, the modulation scheme is carried out according to an algorithm of formula (1):

$$S(t)=(P\text{max}-P\text{min})*\sin(\text{trajectory}(t))+P\text{avg} \quad (1),$$

wherein, sin is a sine wave related to the design of the rotor blades and trajectory(t) is the trajectory algorithm, in which the motor is instructed to drive the motor to continue its trajectory without going backward when the modulator is at its maximum or minimum pressure. In some embodiments, the trajectory algorithm is a quadrature amplitude modulation (QAM) trajectory algorithm according to formulas (2) and (3):

$$S(t)=(P\text{max}-P\text{min})*\text{Sin}(2\pi ft+\phi_n)*A_n \quad (2)$$

$$\text{trajectory}(t)_n=A\ \sin(\text{Sin}(2\pi ft+\phi_n)*A_n) \quad (3),$$

wherein $A_n$ is the amplitude, provided that amplitude and phase transitions are performed simultaneously by using a trajectory $\phi((t)$ which possesses the following attributes:

$\phi(t)$ is derivable two times for t ranging from $t_n$ to $t_{n+1}$ $\phi(t_n)=0$ and $\phi(t_{n+})=1$ $\phi(t)$ is a function that allows smoothly completing the transition from trajectory $t_n$ to $t_{n+1}$, wherein $\text{trajectory}(t)=(\text{trajectory}(t)_{n+1}*\phi(t)+\text{trajectory}(t)_n*(1-\phi(t))$, and further provided that when $A_n=1$ (representing maximum amplitude), the motor drives the rotor in a classic rotational (fully rotational) movement.

Figure 4B:
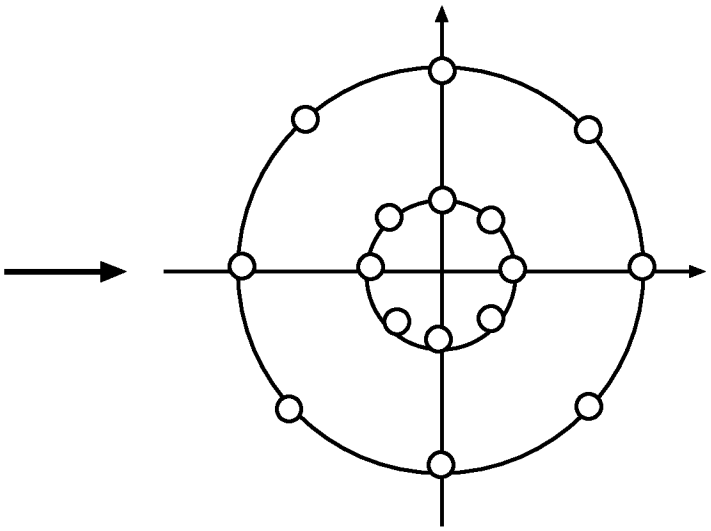
FIGS. 4*a* and 4*b* are embodiments of QAM circular constellation diagrams that may be used as the basis for modulation schemes consistent with this disclosure, and which are used to drive a rotor relative a stator resulting in mud pulses representative of recorded downhole data.
Figure 4A:
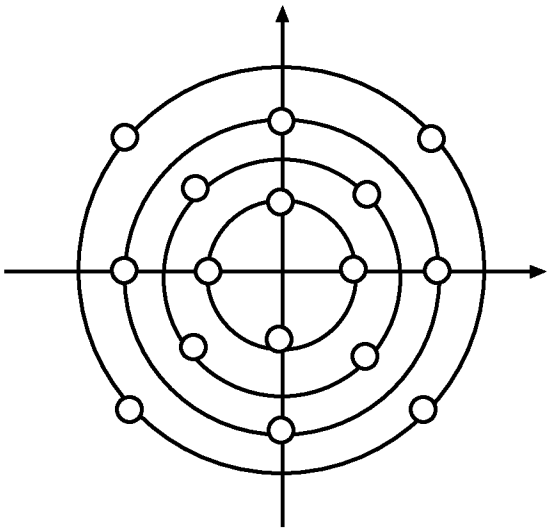

In some embodiments, the modulation scheme is a QAM modulation scheme based on a circular constellation diagram, wherein notations (symbols) on the outermost ring of the constellation diagrams result in the motor driving the rotor in a classic rotational (fully rotational) movement. FIGS. 4*a* and 4*b* illustrate embodiments of a 16-QAM circular constellation diagram and QAM circular constellation diagram with only two amplitudes, respectively. With respect to the 16-QAM diagram, the innermost ring represents 25% amplitude, the next innermost ring represents 50% amplitude, the third ring represents 75% amplitude, and the outermost ring represents 100% amplitude. Symbols with the closest amplitude are placed on the same circle. In some embodiments, QAM modulation schemes based on a circular constellation diagram reduce the time when the stator openings are partially closed by a 25% factor with a minimum loss of signal to noise ratio.

In operation, one or more downhole tools record data, a telemetry system transmits at least a portion of the data as modulated mud pulses representative of the recorded data, and a demodulator may reconstruct the original, recorded data. Some methods according to this disclosure involve driving a rotor-stator unit disposed within a drill string according to a modulation scheme resulting in both oscillating movement and full rotational movement of the rotor relative the stator, wherein the movement generates the modulated mud pulses, i.e. an encoded signal comprising pressure fluctuations in drilling fluid passing through the rotor-stator unit. The modulation scheme can be, for example, any of the modulation schemes described above.

Figure 6A:
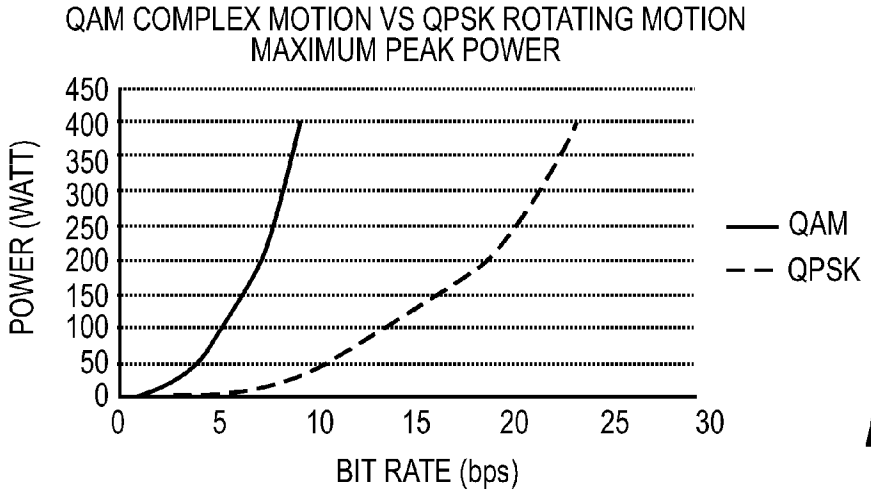
FIGS. 6*a* and 6*b* are graphs comparing power efficiency of a rotor-stator modulator unit operating according to a QAM algorithm consistent with this disclosure (comprising both oscillating and full rotational motion) versus a traditional QPSK algorithm.
Figure 6B:
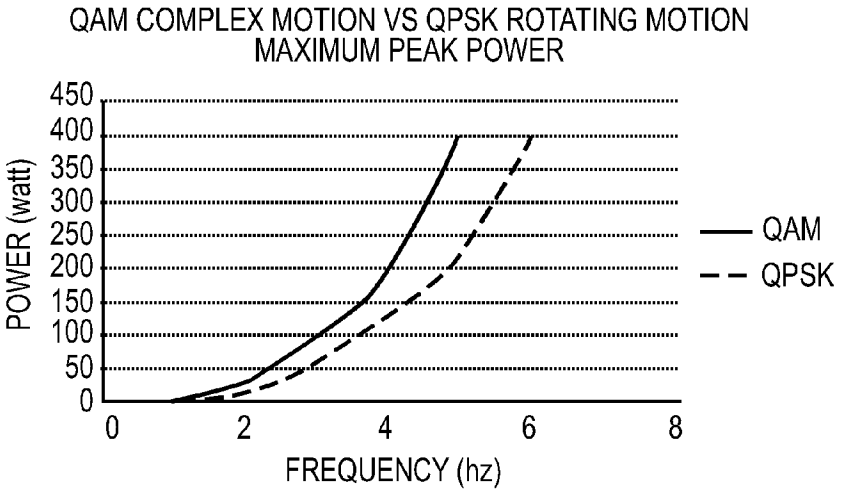

FIGS. 6*a* and 6*b* graphically illustrate the result of a comparative example demonstrating the power advantage of some embodiments of devices, systems, and methods according to this disclosure. In accordance with the example, a QAM trajectory according to this disclosure (involving both oscillating and rotational motion) and a traditional QPSK trajectory were tested on an MWD tool with the following characteristics:

Turbine alternator:

Peak power delivery: 1 Kwatts

Average power delivery: 100 watts

Motor and modulator (rotor-stator) assembly:

Inertia: 0.000327 $NMs^2$

Peak torque: 5 Nm

QAM trajectory (2 Hz 8 bps, to modulate from 25% amplitude to 100% amplitude with 180 degree phase shift):

Peak acceleration: 529 $rad/s^2$

Peak speed: 36 rad/s

Peak torque: Peak acceleration*Inertia=0.17 Nm

Peak power: Peak (torque*Peak)=2.48 Watts

QPSK trajectory (2 Hz 4 bps, for 180 degree phase shift) or QAM trajectory (2 Hz, 8 bps, 100% amplitude with 180 degree phase shift)

Peak acceleration: 815 rad/s$^2$

Peak speed 60 rad/s

Peak torque: Peak acceleration*Inertia=0.33 Nm

Peak power: Peak (torque*speed)−21 Watts.

As the graphs demonstrate, operating the rotor-stator according to an algorithm consistent with this disclosure is more power effective (peak) than classis QPSK rotating motion to transmit at the same bit rate. Usually, less than 12 bits per second are used, making the electrical power not a limitation to perform the QAM algorithm. In some embodiments, wherein new generation MWD tools are used, which are able to delivery hundreds of watts on average (and almost a thousand in a peak), the rotor uses less than half a hundred to perform encoding in accordance with the disclosure.

A number of embodiments have been described. Nevertheless it will be understood that various modifications may be made without departing from the spirit and scope of the invention.

Accordingly, other embodiments are included as part of the invention and may be encompassed by the attached claims. Furthermore, the foregoing description of various embodiments does not necessarily imply exclusion. For example, "some" embodiments or "other" embodiments may include all or part of "some", "other" and "further" embodiments within the scope of this invention.

What is claimed is:

1. An apparatus for mud pulse telemetry, comprising:

a. a motor-driven rotor-stator combination configured for use in a drill string; and, b. a drive and control system configured to operate the motor to drive the rotor relative to the stator in rotation around a predetermined axis according to a modulation scheme resulting in motion comprising both oscillating movement and full rotational movement, wherein the modulation scheme S(t) is carried out according to an algorithm of formula (1):

$$S(t)=(P\text{max}-P\text{min})\text{Sin}(\text{trajectory}(t))+P\text{avg} \quad (1)$$

wherein, sin is a sine wave related to design of the rotor blades; and, trajectory(t) is a trajectory algorithm and Pmax is a pressure at a closed position, wherein the blades of the rotor block openings of the stator to the maximum extent possible Pmin is a pressure at an open position, wherein the blades of the rotor do not block openings of the stator Pavg is an average pressure.

2. The apparatus according to claim 1, wherein the rotor has blades having a shape and the rotor is capable of producing a sine wave having an amplitude when the blades are rotated at a constant speed, and the modulation scheme is designed to access the full amplitude of the sine wave based on the rotor shape.

3. The apparatus according to claim 1, wherein the trajectory algorithm is a QAM trajectory algorithm $$S(t)=(P\text{max}-P\text{min})\sin(2\pi ft+\phi_n)A_n+P\text{avg} \quad (2)$$

$$\text{and trajectory}(t)_n=A\ \sin(\text{Sin}(2\pi ft+\phi_n)A_n),$$

wherein, $A_n$ is amplitude, and $\phi_n$ is phase and f is carrier frequency.

4. The apparatus according to claim 1, wherein amplitude and phase transitions are done simultaneously using a trajectory ϕ((t) which possesses the following attributes:

ϕ(t) is derivable two times for t ranging from t to $t_n$ to $t_{n+1}$ $\phi(t_n)=0$ and $\phi(t_{n+1})=1$ ϕ(t) is a function that allows smoothly completing the transition from trajectory $t_n$ to $t_{n+1}$, wherein $$\text{trajectory}(t)=(\text{trajectory}(t)_{n+1}*\phi(t)+\text{trajectory}(t)_n*(1-\phi(t)).$$

5. The apparatus according to claim 3, wherein when An=1, the motor can drive the rotor to continue the trajectory trajectory(t) without going backward when at maximum or minimum pressure.

6. The apparatus according to claim 1, wherein the modulation scheme is based on a circular constellation diagram.

7. The apparatus according to claim 6, wherein the circular constellation diagram has at least two concentric rings.

8. The apparatus according to claim 7, wherein the circular constellation diagram has a first innermost ring representing 25% amplitude, a second ring representing 50% amplitude, a third ring representing 75% amplitude and a fourth outermost ring representing full amplitude.

9. The apparatus according to claim 7, wherein a point located on an outermost ring causes the motor to drive the rotor to continue its trajectory without going backward.

10. A mud pulse telemetry system, comprising an apparatus according to claim 1.

11. The mud pulse telemetry system according to claim 10, wherein the control and drive system comprises a motor for driving the rotor, and a processor comprising instructions for driving the motor.

12. The mud pulse telemetry system according to claim 10, wherein the modulation scheme comprises driving the motor to drive the rotor in full rotational movement if maximum amplitude is achieved.

13. The mud pulse telemetry system according to claim 10, further comprising a processor for decoding pressure fluctuations in the drilling fluid resulting from movement of the rotor.

14. A mud pulse telemetry method for transmitting downhole information to surface, comprising: driving a rotor-stator unit disposed within a drill string according to a modulation scheme resulting in both oscillating movement and full rotational movement of the rotor relative the stator and around a predetermined axis, wherein the movement of the rotor generates an encoded signal comprising pressure fluctuations in drilling fluid passing through the rotor-stator unit, wherein the modulation scheme is carried out according to an algorithm of formula (1):

$$S(t)=(P\text{max}-P\text{min})\text{Sin}(\text{trajectory}(t))+P\text{avg} \quad (1)$$

wherein, sin is a sine wave related to design of the rotor blades; and, trajectory(t) is a trajectory algorithm Pmax is a pressure at a closed position, wherein the blades of the rotor block openings of the stator to the maximum extent possible Pmin is a pressure at an open position, wherein the blades of the rotor do not block openings of the stator Pavg is an average pressure.

15. The mud pulse telemetry method according to claim 14, wherein the modulation scheme is based on a circular constellation diagram having an outermost ring, and when the modulation scheme includes a point on the outermost ring, the method comprises driving the rotor to continue its trajectory without going backward when at maximum or minimum pressure.

16. The mud pulse telemetry method according to claim 14, wherein the trajectory algorithm is a QAM trajectory algorithm $$S(t)=(P\max-P\min)\sin(2\pi ft+\phi_n)A_n+P\text{avg} \quad (2)$$

$$\text{and trajectory}(t)_n=A\ \sin(\text{Sin}(2\pi ft+\phi_n)A_n),$$

wherein, $A_n$ is amplitude, and $\phi_n$ is phase and f is carrier frequency.

17. The mud pulse telemetry method according to claim 14, wherein amplitude and phase transitions are done simultaneously using a trajectory $\phi((t)$ which possesses the following attributes:

$\phi(t)$ is derivable two times for t ranging from $t_n$ to $t_{n+1}$ $\phi(t_n)=0$ and $\phi(t_{n+1})=1$ $\phi(t)$ is a function that allows smoothly completing the transition from trajectory $t_n$ to $t_{n+1}$, wherein $$\text{trajectory}(t)=(\text{trajectory}(t)_{n+1}*\phi(t)+\text{trajectory}(t)_n*(1-\phi(t)).$$

18. The mud pulse telemetry method according to claim 16, wherein An=1, the method comprises driving the rotor to continue the trajectory trajectory(t) without going backward when at maximum or minimum pressure.

* * * * *